US005221138A

United States Patent [19]

Bostjancic et al.

[11] Patent Number: 5,221,138

[45] Date of Patent: Jun. 22, 1993

[54] SERIAL LIGHT FIXTURE

[75] Inventors: Paul Bostjancic, Elwood; Len Laskowski, Lockport, both of Ill.

[73] Assignee: Ready Metal Manufacturing Company, Chicago, Ill.

[21] Appl. No.: 710,139

[22] Filed: Jun. 4, 1991

[51] Int. Cl.[5] ..... F21S 3/14; F21V 21/22; F21V 21/34

[52] U.S. Cl. ..... 362/221; 362/147; 362/219; 362/370; 362/371; 362/432

[58] Field of Search ..... 362/147, 151, 221, 225, 362/249, 260, 368, 370, 371, 219, 217, 250, 285, 431, 432; 248/200.1

[56] References Cited

U.S. PATENT DOCUMENTS

| | | | |
|---|---|---|---|
| 2,288,941 | 7/1942 | Curtis | 362/219 |
| 2,810,823 | 10/1957 | Guth, Jr. | 362/225 |
| 3,086,105 | 4/1963 | Westermann | 362/219 |
| 3,349,237 | 10/1967 | Jackson | 362/219 |
| 4,152,757 | 5/1979 | Bilson et al. | 362/217 |
| 4,407,011 | 9/1983 | Lahm | 362/249 |
| 4,726,781 | 2/1988 | Bernhart et al. | 362/219 |
| 4,814,954 | 3/1989 | Spitz | 362/260 |
| 4,994,943 | 2/1991 | Aspenwall | 362/432 |
| 5,025,356 | 6/1991 | Gawad | 362/221 |

FOREIGN PATENT DOCUMENTS

| | | | |
|---|---|---|---|
| 223691 | 1/1958 | Australia | 362/217 |
| 718270 | 11/1954 | United Kingdom | 362/219 |

*Primary Examiner*—Ira S. Lazarus
*Assistant Examiner*—Y. Quach
*Attorney, Agent, or Firm*—Dvorak & Traub

[57] ABSTRACT

A light fixture has opposed ends terminating in end panels, the housing having top and bottom walls and sides defining a light-emitting area, the top wall being provided with a rail. A pair of spaced lamp holders for supporting a fluorescent lamp is supported by insertable support means which are secured to the undersurface of the top wall. An elongated reflector extends between the ends of the housing and is positioned in the light-emitting area and fastened to the support means. A conduit-receiving opening is provided in each panel and is covered by a dome plug, each panel also having an opening for removably supporting a circuit plug. In a support system for adjustably supporting several light fixtures in an end-to-end relationship, each fixture having a top provided with a coupling member. The adjustable arm has inner and outer members telescopically interengaged, one end of the arm being secured to a wall-mounting bracket, and the other end of the arm being secured to a light fixture supporting bracket which has slidable means engageable with the coupling member. To prevent movements along the longitudinal and transverse axes of the aligned end-to-end light fixtures, a splicing member is provided to intercouple with the coupling members on the housings.

8 Claims, 2 Drawing Sheets

SERIAL LIGHT FIXTURE

BACKGROUND OF THE INVENTION

1. Field of the Invention

This invention is concerned with a light fixture, and more particularly, with a type of light fixture which can be readily interconnected with additional light fixtures coupled together in longitudinal series.

2. Description of the Prior Art

Commonly connecting a number of elongated light fixtures serially to provide illumination over an extensive length of a room is known. However, the means employed to interconnect adjoining light fixtures are cumbersome and are spaced by gaps which do not provide a pleasing appearance and do not provide uniform light intensity along the length of the assembled light fixtures. A light fixture assembly which includes a light fixture and a support system for supporting the assembly from a ceiling or a wall is also known. However, the known support systems employed for this purpose are of a type that secure the light fixture rigidly to a supporting surface. This type of support system does not permit adjustable positioning of the light fixture or to accommodate various lengths of light fixtures.

SUMMARY OF THE INVENTION

The main object of the invention is to provide means for interconnecting serially aligned elongated light fixtures to provide a light source having a uniform illumination dispersal.

A further object of the invention is to provide a light fixture having end panels each of which is provided with means for connecting to an electrical conduit and with means for intercoupling with an abutting end panel of another adjoining light fixture.

A further object of the invention is to provide support means for supporting longitudinally aligned light fixtures which can be slidably moved with respect to each other and with respect to a cornice concealing the light fixtures.

Another object of the invention is to provide fluorescent lamp holders mounted on brackets readily insertable into a housing of the light fixture.

A still further object of the invention is to provide a light fixture having end panels furnished with electrical connectors which do not expose electrical contacts.

Still another object of the invention is to provide an elongated light fixture with a support rail extending longitudinally of the housing of the light fixture and providing sliding grooves for positioning the light fixture with respect to its support system.

Another object of the invention is to provide a member for splicing adjoining abutting light fixtures to provide rigidity to a serial arrangement of the light fixtures.

A still further object of the invention is to provide a light fixture assembly wherein the light fixture is slidably positioned with respect to its support system and adjustably positioned on the support system with respect to a cornice.

A light fixture comprises an elongated housing having ends terminated in end panels, the housing having a top wall, an elongated support rail aligned with the housing and secured to the top wall. The housing has a pair of spaced side walls extending outwardly from the top wall while one of the side walls terminates in a bottom wall. The bottom wall and the other side wall together with the end panels define a light-emitting area. A pair of spaced lamp holders support a fluorescent lamp therebetween. The lamp holders are supported by insertable support means. An elongated reflector extends between the ends of the housing and positioned in the light-emitting area. Means are provided for securing the reflector to the support means. A conduit-receiving opening in each end panel is provided with a snap bushing which is closed by a dome plug and a circuit plug removably mounted in the end panel.

A support system for adjustably supporting an elongated light fixture provided with an elongated coupling member has an adjustable arm having an inner member telescopically engaging an outer member. The outer end of the outer member is secured to a wall-mounting bracket. The outer end of the inner member is secured to a fixture-supporting bracket. Means on the fixture-supporting bracket are provided for slidably engaging with the coupling member.

An arrangement has coupling and supporting means for at least two elongated light fixtures aligned in an end-to-end relationship. Each light fixture is provided with an elongated coupling member. The supporting means for each light fixture has an adjustable arm having an inner member telescopically received in an outer member, the outer end of the outer member being secured to a wall-mounting bracket, the outer end of the inner member being secured to a light fixture supporting bracket, and slidable means on the fixture-supporting bracket for slidably engaging with the coupling members, the coupling means having splicing member interposed between adjoining ends of the light fixtures and having opposite ends engageable with the coupling members.

BRIEF DESCRIPTION OF THE DRAWINGS

Reference is now made to the drawings forming a part of the specification and illustrating the preferred embodiment of the invention.

DESCRIPTION OF THE PREFERRED EMBODIMENT

Figures 1, 2, 5:
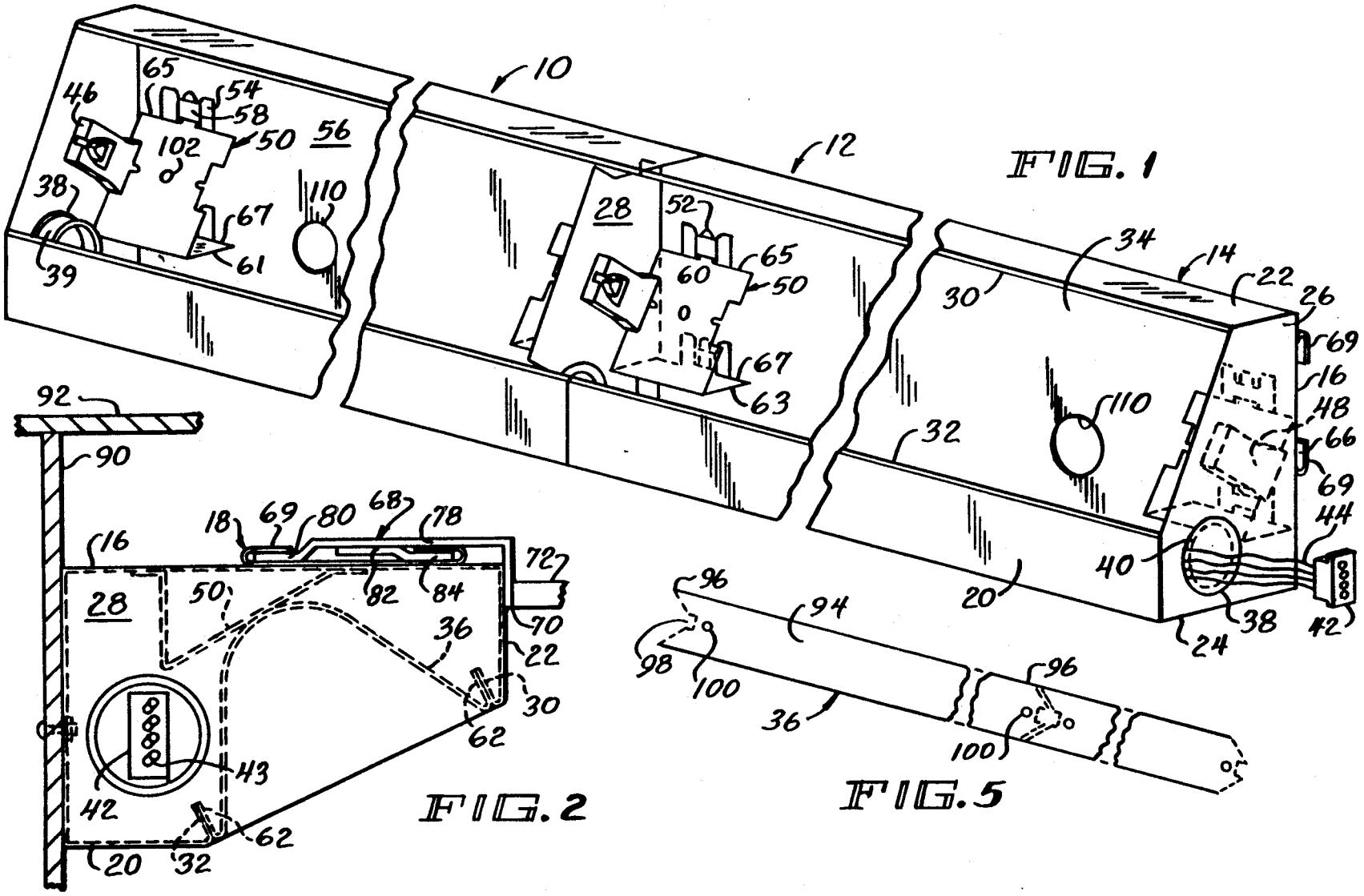
FIG. 1 is a perspective of two light fixtures serially abutting each other.
FIG. 2 is an enlarged end view of one of the light fixtures.
FIG. 5 shows a pair of reflectors in two adjoining light fixtures.

FIG. 1 shows light fixtures 10 and 12 serially connected together in an end abutting relationship. Each of the light fixtures, such as light fixture 12, comprises a housing 14 having a top 16 provided with an elongated support rail 18 extending substantially along the length of the housing 14, a bottom 20, opposed sides 22 and 24, and a pair of enclosing end panels 26 and 28. Between edge 3 of the side 22, edge 32 of the bottom 20 and the end panels 26 and 28, there is defined an opening 34 for receiving a reflector 36, as indicated by a broken line adjacent the end panel 28. Each end panel 26 and 28 is provided with an opening 38 provided with a snap bushing 39 closed by a dome plug 40 (shown in phantom in FIG. 1) which is removable for the purpose of connecting the light fixture to a conduit containing electrical power. Also, each end panel 26 and 28 is provided with a plug 42 which is connected to an electrical circuit (not shown) inside the housing 14 by leads 44 which are long enough to facilitate unsnapping of the plug. Actually, the end panel 26 is provided with recessed female pins, and the end panel 28 is provided with male pins, so that the plug 42 interconnects abutting light fixtures 10 and 12.

For supporting a fluorescent light tube (not shown), there is provided a pair of spaced lamp holders 46 and 48, each of the lamp holders being supported on a bracket 50 provided with a pair of tabs 52 insertable into tab holders 54 in a wall 56 which defines the top 16. The tab holder 54 has a band 58 for engaging the tab 52. As a further alternative in the construction of the tab holder, the band 58 could be punched out of the wall 56. As best shown in FIG. 2, the bracket 50 supports the reflector 36 which has ends 62 engaging the edges 30 and 32 of the sides 20 and 22, respectively. The bracket 50 has a base 60 and a leg 61 extending angularly from the base and defining an acute angle 63, one edge 65 of the base 60 and one edge 67 of the leg 61 abut the wall 56.

As mentioned earlier, the top 16 of the light housing 14 is provided with a rail 18 having elongated side portions 69 rolled over to define a pair of sliding grooves 66 for engagement with a holding bracket 68 secured to one end 70 of an adjustable arm 72 which has its other end 71 secured to a mounting bracket 74 provided with hooks 76 adapted to engage vertical standards (not shown) on a wall (not shown). The holding bracket 68 has an upper member 78 terminating in a foot 80 engaged in one of the sliding grooves 66. The holding bracket 68 has a lower member 82 welded to the underside of the upper member 78 and having one end terminating in a foot 84 engageable in the other of the sliding grooves 66. The adjustable arm 72 is a telescopic arrangement of an inner oblong tubular member 86 slidable in an outer tubular member 88. The telescopic arrangement of the arm 72 permits proper positioning of the light fixture 12 with respect to a cornice 90, as shown in FIG. 2, supported from a ceiling 92 in a room.

As shown in FIG. 5, the reflector 36 has an elongated arcuate face 94 having its ends 96 provided with cutouts 98 for receiving respective lamp holders 46. The reflector 36 has a pair of apertures 100 adapted to align with apertures 102 in respective brackets 50 for receiving screws for fastening the reflector in the housing 14.

Figure 3:
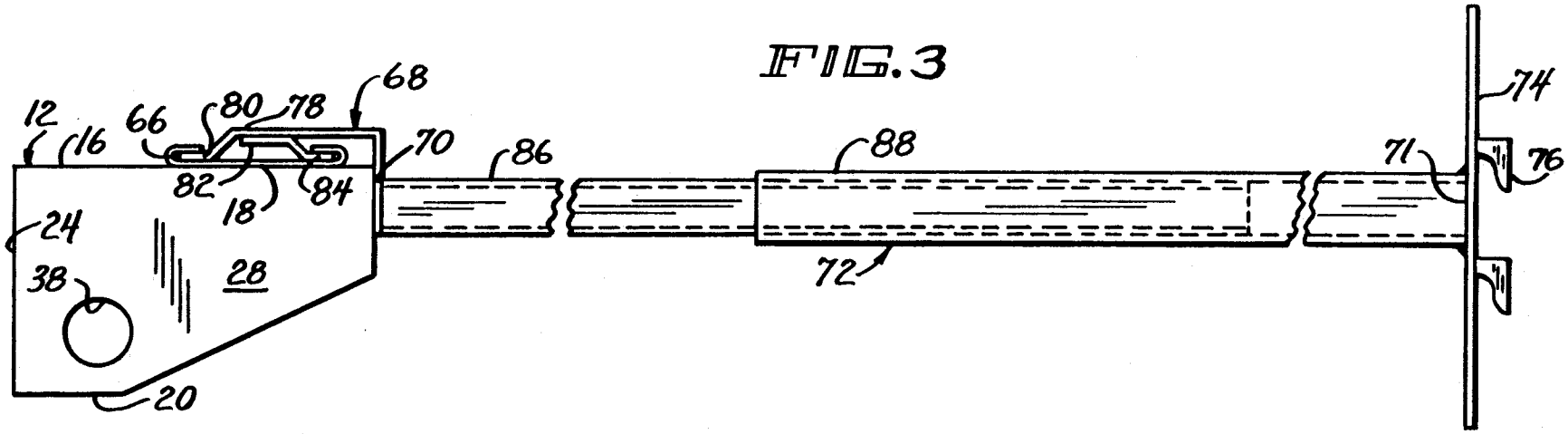
FIG. 3 shows a support system for adjustably supporting a light fixture in three dimensions.
Figure 6:
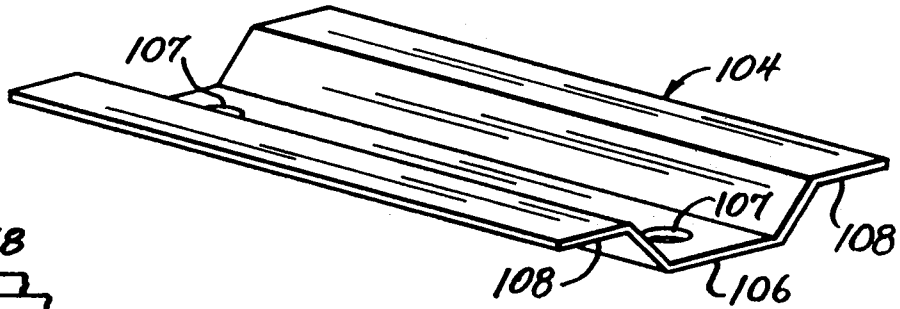
FIG. 6 is a perspective view of the splicing member.
Figure 4:
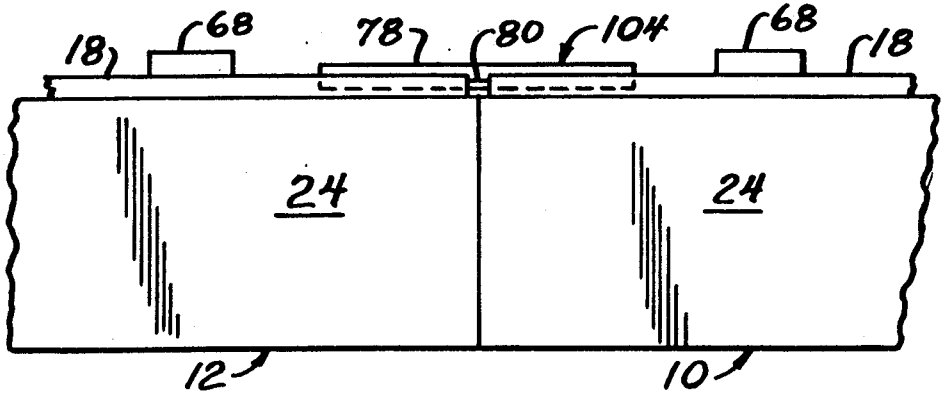
FIG. 4 shows a pair of abutting light fixtures coupled together by a splicing member.

Referring to FIG. 6, there is shown a splicing member 104 having a ridge 106 terminating angularly in a pair of feet 108. The splicing member 104, as shown in FIG. 4, is adapted to rigidity the interconnection existing between adjoining light fixtures 10 and 12. The splicing member 104 is adapted to have its feet 108 engaged in the sliding grooves 66 of the support rail 18, as best viewed in FIG. 3. A pair of apertures 107 in the spicing member 104 are adapted to overlie similar apertures 110 existing in the top 16 so that snap buttons (not shown) can be inserted to interlock adjoining lighting fixtures 10 and 12

While there has been described what is at present considered to be the preferred embodiment of the invention, it will be understood that various modifications may be made therein, and it is intended to cover in the appended claims, all such modifications as fall within the true spirit and scope of the invention.

What is claimed is:

1. A light fixture comprising an elongated housing having ends terminated in end panels, said elongated housing having a top wall, an elongated support rail aligned with said elongated housing and secured to said top wall, said elongated housing having a pair of spaced walls extending outwardly from said top wall, one of said walls terminating in a bottom wall, said bottom wall and the other of said walls together with said end panels defining a light emitting area, a pair of spaced lamp holders adapted for supporting a lamp therebetween, insertable support means for supporting said spaced lamp holders in said elongated housing, an elongated reflector extending between the ends of said elongated housing and positioned in said light-emitting area, means for securing said elongated reflector to said insertable support means, a conduit receiving opening in each end panel, removable means for closing said conduit receiving opening, a circuit plug receiving opening in each end panel, and a circuit plug removably mounted in said circuit plug receiving opening.

2. A light fixture according to claim 1, wherein said insertable support means comprise a pair of spaced brackets insertably secured to said top wall.

3. A light fixture according to claim 2, wherein each bracket comprises a base, a leg extending angularly from said base and defining an acute angle, one edge of said base and one edge of said leg abutting said top wall, each of said edges being provided with a tab, and means of said top wall adapted to receive the insertion of said tabs.

4. A light fixture according to claim 1, wherein said elongated support rail has elongated said portions rolled over to define a pair of spaced grooves.

5. A support system for adjustably supporting an elongated light fixture provided with an elongated coupling member, comprising an adjustable arm having an inner member telescopically engaging an outer member, an outer end of the outer member being secured to a wall mounting bracket, an outer end of the inner member being secured to a fixture supporting bracket, means on said fixture supporting bracket for slidably engaging with each elongated coupling member, wherein said elongated coupling member has slidably receiving means, and said fixture supporting bracket has slidably engaging means for engaging with said slidably receiving means to establish transverse adjustability of said elongated light fixture with respect to said adjustable arm, and said slidably receiving means comprises a pair of spaced rolled-over longitudinal portions of said elongated coupling member defining a pair of spaced opposed grooves, and said slidably engaging means comprises a pair of spaced feet extending outwardly from said fixture supporting bracket and engageable with said spaced opposed grooves.

6. An arrangement having coupling and supporting means for at least two elongated light fixtures aligned in an end-to-end relationship, each elongated light fixture being provided with an elongated coupling member, the supporting means for each elongated light fixture comprising an adjustable arm having an inner member telescopically received in an outer member, an outer end of the outer member being secured to a wall-mounting bracket, an outer end of the inner member being secured to a light fixture supporting bracket, and slidable means on said fixture supporting bracket for slidably engaging with said elongated coupling member, coupling means comprising a splicing member interposed between adjoining ends of said elongated light fixtures and having opposite ends engageable with said elongated coupling members.

7. An arrangement according to claim 6, wherein each of said elongated coupling members comprises a pair of spaced rolled-over longitudinal portions defining a pair of spaced opposed grooves, and said slidable means comprises a pair of spaced feet extending outwardly from said fixture supporting bracket and engageable with said spaced opposed grooves, said opposite ends of said splicing member being engageable with all of said spaced opposed grooves.

8. An arrangement according to claim 7, wherein said splicing member comprises a rectangular member having a central portion along a longitudinal axis and defining a ridge, a leg extending outwardly and angularly from each internal side of said ridge, a foot extending from each leg, the feet being parallel to a plane of said ridge, said feet being engaged with the spaced opposed grooves in both of said elongated coupling members to prevent longitudinal and transverse movements between the elongated light fixtures.

* * * * *